US012427361B1

(12) United States Patent
Xu et al.

(10) Patent No.: US 12,427,361 B1
(45) Date of Patent: Sep. 30, 2025

(54) TELESCOPIC ASSEMBLY FOR ADJUSTABLE DUMBBELL AND ADJUSTABLE DUMBBELL

(71) Applicant: Zhuping Xu, Yongkang (CN)

(72) Inventors: Zhuping Xu, Yongkang (CN); Renzheng Wu, Yongkang (CN); Yi Zhou, Jinhua (CN)

(73) Assignee: Zhuping Xu, Yongkang (CN)

( * ) Notice: Subject to any disclaimer, the term of this patent is extended or adjusted under 35 U.S.C. 154(b) by 0 days.

(21) Appl. No.: 19/083,253

(22) Filed: Mar. 18, 2025

(30) Foreign Application Priority Data

Sep. 26, 2024 (CN) ..... 202411346475.6

(51) Int. Cl.
*A63B 21/072* (2006.01)
*A63B 21/075* (2006.01)

(52) U.S. Cl.
CPC ..... *A63B 21/0726* (2013.01); *A63B 21/0728* (2013.01); *A63B 21/075* (2013.01)

(58) Field of Classification Search
CPC ..... A63B 21/0726; A63B 21/0728; A63B 21/075
See application file for complete search history.

(56) References Cited

U.S. PATENT DOCUMENTS

2022/0152443 A1* 5/2022 Casagrande ..... A63B 21/0728
2022/0331642 A1* 10/2022 Casagrande ..... A63B 21/075
2023/0001258 A1* 1/2023 Svenberg ..... A63B 21/0724
2023/0052772 A1* 2/2023 Wang ..... A63B 21/075
2023/0347200 A1* 11/2023 Casagrande ..... A63B 21/075

FOREIGN PATENT DOCUMENTS

CN 212282678 U * 1/2021 ..... A63B 21/075
CN 112741992 A * 5/2021 ..... A63B 21/00065
CN 113144514 A * 7/2021 ..... A63B 21/0724
CN 114028764 A * 2/2022
CN 215781228 U * 2/2022
CN 221964416 U * 11/2024
CN 222238673 U * 12/2024

* cited by examiner

*Primary Examiner* — Joshua T Kennedy
(74) *Attorney, Agent, or Firm* — Birchwood IP

(57) ABSTRACT

There is provided a telescopic assembly for an adjustable dumbbell, including a rotating rod and a telescopic rod. The rotating rod is a hollow round rod. The telescopic rod includes two semi-cylindrical rods split in half. The telescopic rod is inserted into the rotating rod. Toggle members are respectively arranged at two ends of the rotating rod. The toggle members are fixedly connected to the rotating rod. Toggle bumps are arranged on the toggle members. Thread grooves with opposite rotating directions are respectively formed in outer cylindrical surfaces of the two semi-cylindrical rods. Two toggle bumps can slide in the thread grooves of the two semi-cylindrical rods, respectively. The thread grooves include zero thread pitch sections and non-zero thread pitch sections. The zero thread pitch sections and the non-zero thread pitch sections are arranged in a staggered manner.

4 Claims, 8 Drawing Sheets

TELESCOPIC ASSEMBLY FOR ADJUSTABLE DUMBBELL AND ADJUSTABLE DUMBBELL

CROSS-REFERENCE TO RELATED APPLICATIONS

This application claims priority to Chinese Patent Application No. 202411346475.6, filed on Sep. 26, 2024, which is hereby incorporated by reference in its entirety.

TECHNICAL FIELD

The present disclosure relates to the technical field of dumbbells, and particularly relates to a telescopic assembly for an adjustable dumbbell and an adjustable dumbbell.

BACKGROUND

A dumbbell is common fitness equipment, which is mainly used to enhance muscular strength and stamina and improve muscle definition and physical coordination. The form of the dumbbell may be adjusted as needed, and there are dumbbells with fixed weights and dumbbells with adjustable weights as well. With respect to the adjustable dumbbells, users are usually allowed to change the weights of the dumbbells by adding or removing weight stacks.

With the continuous development of production technology, an adjustable dumbbell with more conveniently changed number of weight stacks has appeared in recent years. Its principle is as follows: a dumbbell base and two groups of weight stacks are arranged. The two groups of weight stacks are respectively arranged at both ends of the dumbbell base. A holding rod is arranged between the two groups of weight stacks. Moreover, a telescopic rod is arranged in the holding rod. By controlling the telescopic rod to stretch out or retract relative to the holding rod, connection to different numbers of weight stacks is realized, so that the weight may be adjusted.

A Chinese invention patent application No. 202110166671.5, titled "handle structure for adjustable dumbbell" discloses a handle structure of a dumbbell. The handle structure is provided with a first screw shaft and a second screw shaft and an insertion block fixedly connected to a rotatable central tube, where the insertion block matches thread grooves in the first screw shaft and the second screw shaft. When a user rotates the central tube, the insertion block rotates along with the central tube to pull the first screw shaft and the second screw shaft to stretch. Moreover, a dumbbell with semi-circular weight stacks is further mentioned in this literature, and the semi-circular weight stacks play a role of refining and increasing adjustable gears of the dumbbell by designing a connection and separation conversion structure, so that the weight of the dumbbell may be changed based on the semi-circular weight stacks. In this solution, the central tube rotates to drive a cam portion on an inner side piece, so that a clamping piece stretches out and retracts to realize the above connection and separation structure. With adoption of such a structure, the user only needs to rotate the central tube to adjust the weight based on the semi-circular weight stacks without other actions.

But such structure also has certain problems: since the semi-circular weight stacks are connected and separated depending on rotation of the cam, the central tube that drives the cam portion to rotate rotates all the time in the connection and separation process, and a screw shaft connected to the central tube all the time will stretch out or retract all the time. To adjust the weights of the semi-circular weight stacks, from separation to connection of the semi-circular weight stacks, the screw shaft cannot stretch into the next intact weight stack, and otherwise, the weight of 1.5 weight stack may be increased or decreased, resulting in functional failure.

The present adjustable dumbbell usually solves this problem by utilizing the thickness of the weight stack itself. When the user rotates to a gear of the central tube, the screw shaft only travels a stroke of the thickness of a half weight stack. When the screw shaft does not stretch into a certain weight stack exactly, the central tube is continuously rotated by a gear, and the screw shaft enters a middle position in the thickness direction of the next weight stack, and in this case, the semi-circular weight stack which is connected is separated; the central tube is continuously rotated by a gear, and the screw shaft further stretches from the middle position in the thickness direction of the weight stack to an alignment position on an end surface of the weight stack, and in this case, the semi-circular weight stack which is separated is connected.

However, such structure has a severe potential safety hazard: when the screw shaft stretches into the farthest weight stack and is connected to the same, it only stretches into the position of the thickness of the half weight stack. It may be contemplated that the weight stack easily falls off in this case. Moreover, if the weight stacks are thin, and there is an error between the thicknesses of the weight stacks or the weight stacks. Under error accumulation, the screw shaft rotating by a gear cannot enter into the position of the thickness of the half weight stack probably, resulting in failure of the whole structure and a huge weight stack falling risk.

SUMMARY

To overcome deficiencies in the prior art, the present disclosure provides a telescopic assembly for an adjustable dumbbell and an adjustable dumbbell. When the adjustable dumbbell is of a half-weight weight stack structure, a weight stack falling risk is reduced, the safety of a dumbbell product is improved, and moreover, the cost is effectively controlled.

In order to solve the above technical problem, the present disclosure adopts the following technical solution:

A telescopic assembly for an adjustable dumbbell includes a rotating rod and a telescopic rod. The rotating rod is a hollow round rod. The telescopic rod includes two semi-cylindrical rods split in half. The telescopic rod is inserted into the rotating rod. Toggle members are respectively arranged at two ends of the rotating rod. The toggle members are fixedly connected to the rotating rod. Toggle bumps are arranged on the toggle members. Thread grooves with opposite rotating directions are respectively formed in outer cylindrical surfaces of the two semi-cylindrical rods. Two toggle bumps can slide in the thread grooves of the two semi-cylindrical rods, respectively. The thread grooves include zero thread pitch sections and non-zero thread pitch sections. The zero thread pitch sections and the non-zero thread pitch sections are arranged in a staggered manner.

As described in the background art, since the user rotates the rotating rod continuously, the movement generated by the toggle members toggling the telescopic rod is also continuous, and with adoption of the semi-weight stack structure, the correct moving mode of the telescopic rod shall be discontinuous, rather than discontinuous.

To improve the safety, a conventional method is to continuously improve the thickness precision of the weight stack, the assembly precision, and the precision of the telescopic structure to ensure that the telescopic shaft stretches out or retract a stroke of the thickness of the half weight stack when the user rotates the rotating rod by a gear. The difficulty in doing this lies in that when the weight stack is thin, the stroke of the thickness of the half weight stack is smaller, and the fault tolerant space is smaller as well. Blindly improving the precision requirement may result in sharp increase of the cost.

Another common method to improve the safety is to arrange a separation and reunion device between the telescopic rod and the rotating rod, so that the moving mode of the telescopic rod which is continuous is turned to discontinuous. The difficulty in doing this lies in that the rotating rod is in tight fit with the telescopic rod, and it is quite difficult to increase the separation and reunion device therebetween, so that the cost needed is also high.

The design of the present disclosure may not only improve the safety without adopting a precision improving mode, but also avoid provision of a complex separation and reunion device between the telescopic rod and the rotating rod, thereby effectively realizing double purposes of improving the safety and controlling the cost simultaneously. Its principle lies in that the thread grooves are designed to include the zero thread pitch sections and non-zero thread pitch sections. When the toggle bumps slide in the non-zero thread pitch sections, the telescopic rod stretches and retracts normally; and when the toggle bumps slide in the zero thread pitch sections, since the thread pitches of the thread sections are 0, the toggle members only rotate planarly equivalently rather than move axially, and the telescopic rod does not stretch, so that a correct discontinuous moving mode is realized. By changing the shapes of the thread grooves, the processing cost is low, and the comprehensive cost of the dumbbell product is effectively controlled.

As a first embodiment of the toggle bumps, the toggle bumps are spherical bumps. Due to the special shapes of the thread grooves, the shapes of the thread grooves will change abruptly at connections between the zero thread pitch sections and the non-zero thread pitch sections, and the moving direction of the toggle members will change greatly. Therefore, it is necessary to design the toggle members in the smooth spherical shape to prevent the gear shifting hand feeling of the user from being affected due to interference.

Further, the toggle bumps are balls, and the balls are embedded onto the toggle members and are capable of rolling. By changing the fixed toggle bumps into rolling balls, the gear shifting smoothness may be further improved.

As a second embodiment of the toggle bumps, the toggle bumps are threaded bumps, the length of each of the threaded bumps extending in an axial direction of the telescopic rod is not greater than the thickness of each of the toggle members in the axial direction of the telescopic rod, and the groove width of each of the zero thread pitch sections is not less than the length of each of the threaded bumps extending in the axial direction of the telescopic rod. The toggle bumps may also be thread bumps, and in this case, the thread bumps are shorter and match the groove sections with the non-zero thread pitches. Such thread bumps slide normally in the non-zero thread pitch sections. When the thread bumps enter into the groove sections with the zero thread pitches, since the groove sections are wider, the whole thread bumps may enter into the groove sections and then the groove sections follow the thread bumps to rotate. In the whole process, the thread shaft does not stretch. The thread bumps have the advantage that the thread bumps are in tight fit with the groove sections with the non-zero thread pitches, so that the stretching precision of the telescopic rod is high.

Further, a projection angle of a central angle of the telescopic rod corresponding to each of the zero thread pitch sections is equal to a projection angle of a central angle of the telescopic rod corresponding to each of the non-zero thread pitch sections in a radial cross section of the telescopic rod. Such design may ensure that the rotating angle of each gear is consistent, which not only improves the usage experience of the user, but also is convenient to design the weight display device.

Further, two or more than two thread grooves are respectively formed in each of the outer cylindrical surfaces of the two semi-cylindrical rods, and the number of the toggle bumps is twice as many as the number of the thread grooves of one semi-cylindrical rod. By arranging a plurality of toggling structures, the toggling reliability and stretching precision may be improved.

Further, the two semi-cylindrical rods are respectively provided with an intact cylinder at a different ends to form an insertion head. Such structure may ensure that the telescopic rod may match the center hole intactly when stretching into the farthest weight stack, so that the weight stack falling risk is further reduced.

Further, the telescopic assembly for an adjustable dumbbell further includes guide bars, where guide grooves are respectively formed at central axes of the two semi-cylindrical rods, and the guide bars are mounted in the guide grooves. Due to special threads of the telescopic shaft, its movement is complex and changeable. By arranging the guide bars and guide grooves, the reliability of the movement of the telescopic shaft may be ensured.

The present disclosure further provides an adjustable dumbbell, including a placing rack, weight stack groups and a holding rod assembly, where two weight stack groups are provided and are both provided with central holes, the two weight stack groups are respectively arranged at both ends of the placing rack, and the holding rod assembly is mounted between the two weight stack groups and penetrating through the central holes; the holding rod assembly includes the telescopic assembly for an adjustable dumbbell described above and a weight stack connecting assembly, the weight stack connecting assembly includes end seat assemblies, weight stacks and a discontinuous connector, two end seat assemblies are provided and respectively connected to the weight stack groups, both ends of the rotating rod are erected in the end seat assemblies and are capable of rotating around a center shaft, and the discontinuous connector is fixedly connected to the rotating rod; when the rotating shaft rotates the toggle bumps to slide in the zero thread pitch sections of the thread grooves, the discontinuous connector is connected to the weight stacks and the end seat assemblies, and the position of a telescopic shaft does not change relative to the central hole; and when the rotating shaft rotates and each of the toggle bumps to slides in each of the non-zero thread pitch sections of each of the thread grooves, the discontinuous connector separates each of the weight stacks from each of the end seat assemblies, and the telescopic shaft stretches out or retracts relative to the position of the central hole. The principle of the adjustable dumbbell product is described above, which is not repeatedly described.

Further, the adjustable dumbbell further includes a weight display device, where the weight display device includes a driving member and a display member, the driving member is fixedly connected to a rotating shaft, and the display member is in transmission connection to the driving member.

To sum up, according to such telescopic assembly for an adjustable dumbbell and an adjustable dumbbell, when the adjustable dumbbell adopts the semi-weight weight stack structure, the weight stack falling risk may be effectively reduced, the safety of the dumbbell product is improved, and the cost may be effectively controlled.

BRIEF DESCRIPTION OF DRAWINGS

The present disclosure will be further described in detail below in conjunction with drawings and specific embodiments.

REFERENCE NUMERALS

Figure 1:
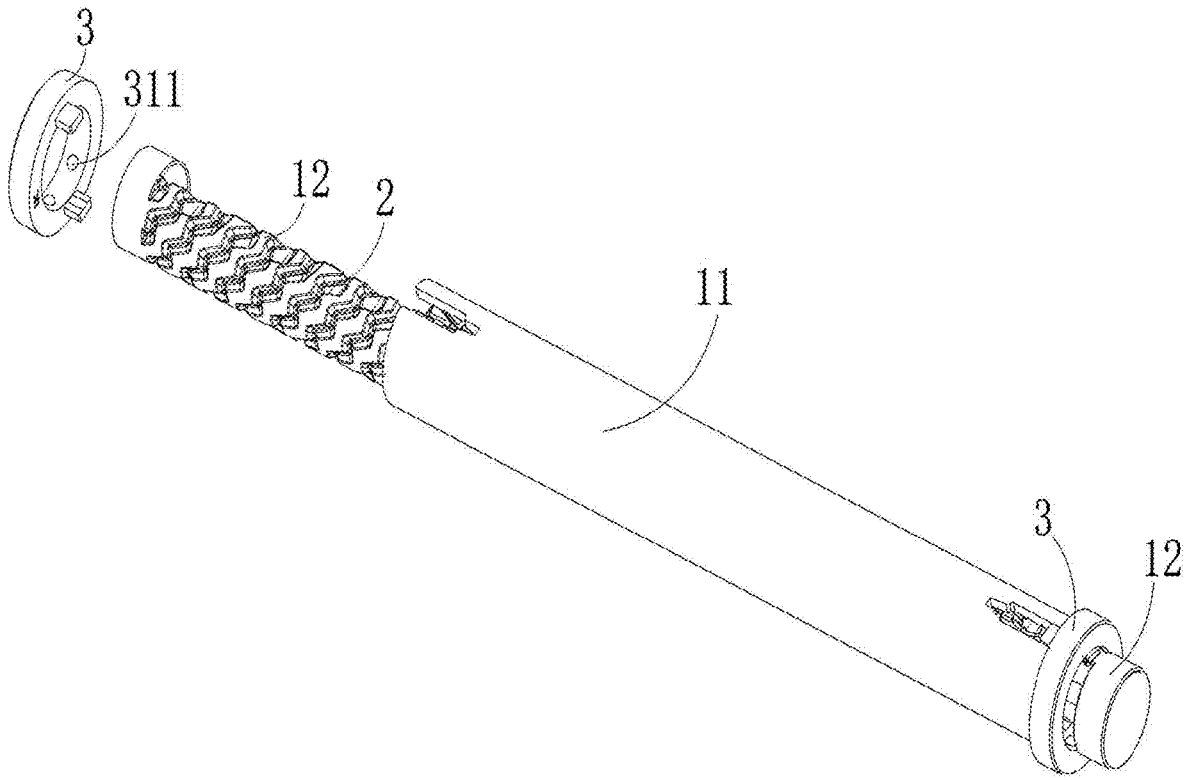
FIG. 1 is an exploded view of a dumbbell in the embodiment.
Figure 2:
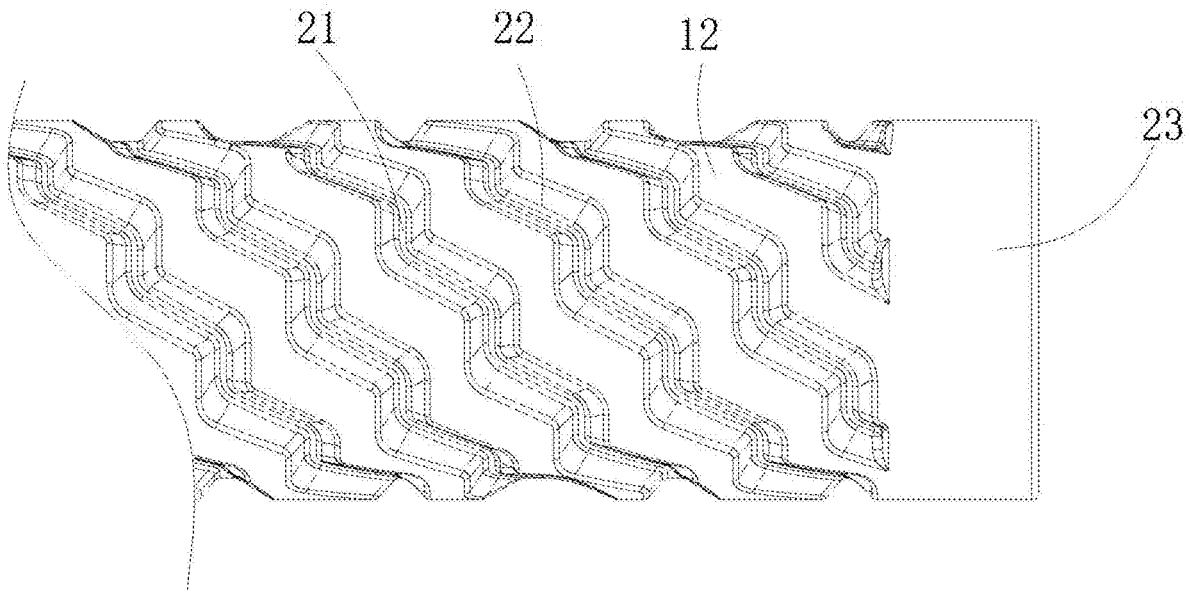
FIG. 2 is a partially enlarged schematic diagram of a spiral groove in the embodiment.
Figure 3:
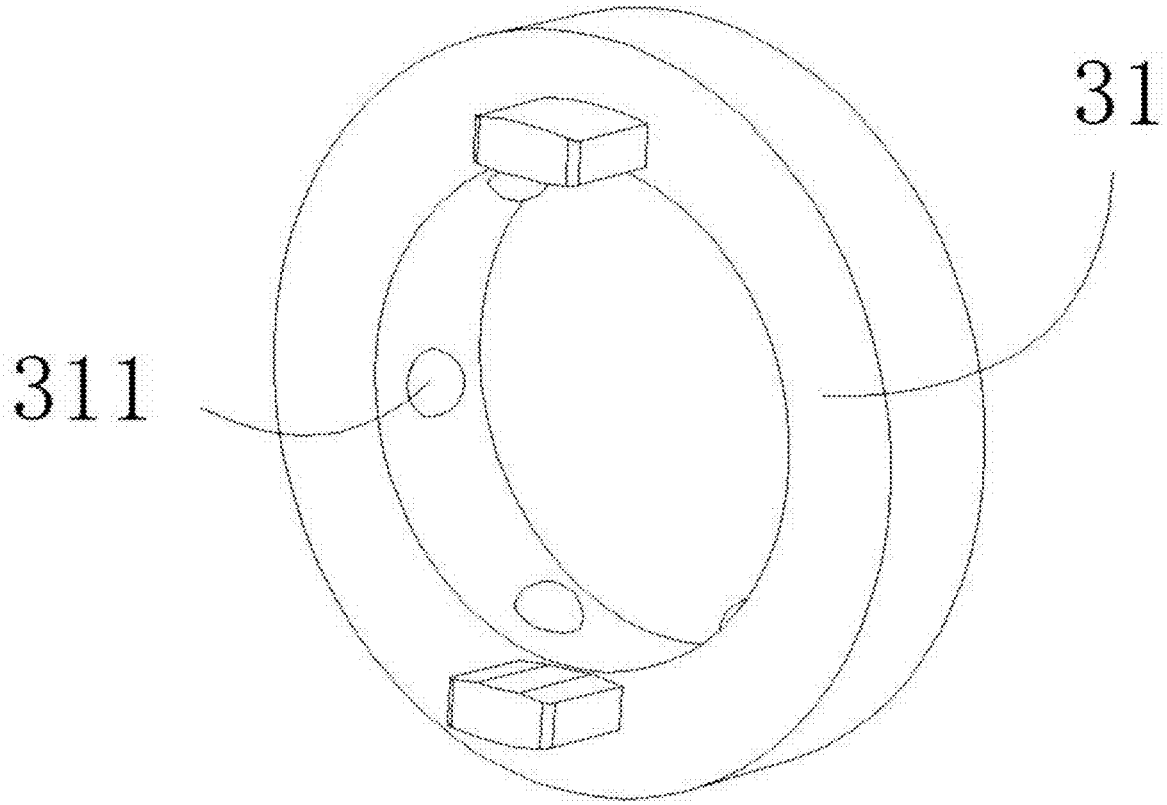
FIG. 3 is a schematic structural diagram of a toggle member in the embodiment.
Figure 4:
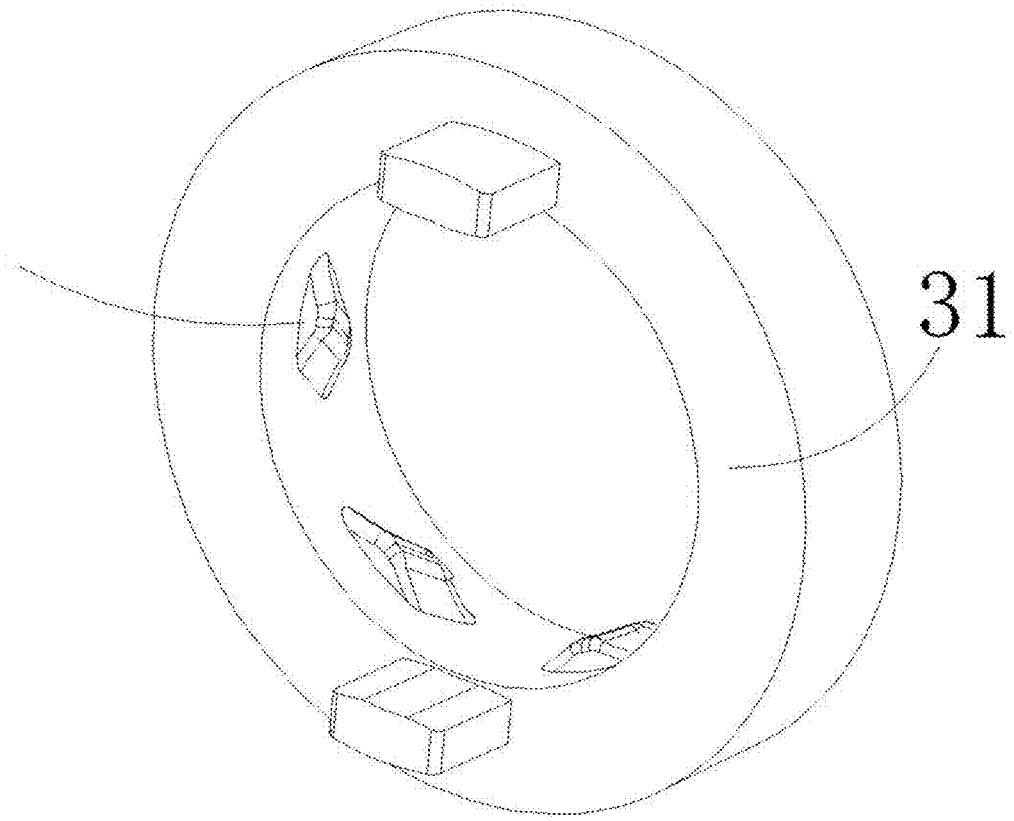
FIG. 4 is another schematic structural diagram of the toggle member in the embodiment.

Holding rod assembly—1
Rotating rod—11
Telescopic rod—12
Semi-cylindrical rod—121
Weight stack connecting assembly—13
End seat assembly—131
Weight stack—132
Discontinuous connector—133
Thread groove—2
Zero thread pitch section—21
Non-zero thread pitch section—22
Insertion head—23
Guide groove—24
Toggle member—3
Toggle bump—31
Spherical bump—311
Thread bump—312
Guide bar—4
Placement rack—5
Weight stack group—6
Center hole—61
Weight display device—7
Driving member—71
Display member—72
Projection plane—f
Projection of zero thread pitch section—f1
Projection of non-zero thread pitch section—f2
Projection of center of circle of semi-cylindrical rod—fo

DESCRIPTION OF EMBODIMENTS

In order to make the objectives, technical solutions, and advantages of the present disclosure more clear, the present disclosure will be further described in detail below in conjunction with the drawings and embodiments.

A telescopic assembly for an adjustable dumbbell includes a rotating rod 11 and a telescopic rod 12. The rotating rod 11 is a hollow round rod. The telescopic rod 12 includes two semi-cylindrical rods 121 split in half. The telescopic rod 12 is inserted into the rotating rod 11. Toggle members 3 are respectively arranged at two ends of the rotating rod 11. The toggle members 3 are fixedly connected to the rotating rod 11. Toggle bumps 31 are arranged on the toggle members 3. Thread grooves 2 with opposite rotating directions are respectively formed in outer cylindrical surfaces of the two semi-cylindrical rods 121. Two toggle bumps 31 can slide in the thread grooves 2 of the two semi-cylindrical rods 121, respectively. The thread grooves 2 include zero thread pitch sections 21 and non-zero thread pitch sections 22. The zero thread pitch sections 21 and the non-zero thread pitch sections 22 are arranged in a staggered manner.

As described in the background art, since the user rotates the rotating rod 11 continuously, the movement generated by the toggle members 3 toggling the telescopic rod 12 is also continuous, and with adoption of the semi-weight stack structure, the correct moving mode of the telescopic rod 12 shall be discontinuous, rather than discontinuous.

To improve the safety, a conventional method is to continuously improve the thickness precision of the weight stack, the assembly precision, and the precision of the telescopic structure to ensure that the telescopic shaft stretches out or retract a stroke of the thickness of the half weight stack when the user rotates the rotating rod by a gear. The difficulty in doing this lies in that when the weight stack is thin, the stroke of the thickness of the half weight stack is smaller, and the fault tolerant space is smaller as well. Blindly improving the precision requirement may result in sharp increase of the cost.

Another common method to improve the safety is to arrange a separation and reunion device between the telescopic rod 12 and the rotating rod 11, so that the moving mode of the telescopic rod 12 which is continuous is turned to discontinuous. The difficulty in doing this lies in that the rotating rod 11 is in tight fit with the telescopic rod 12, and it is quite difficult to increase the separation and reunion device therebetween, so that the cost needed is also high.

The design of the present disclosure may not only improve the safety without adopting a precision improving mode, but also avoid provision of a complex separation and reunion device between the telescopic rod 12 and the rotating rod 11, thereby effectively realizing double purposes of improving the safety and controlling the cost simultaneously. Its principle lies in that the thread grooves 2 are designed to include the zero thread pitch sections 21 and non-zero thread pitch sections 22. When the toggle bumps 31 slide in the non-zero thread pitch sections 22, the telescopic rod 12 stretches and retracts normally; and when the toggle bumps 31 slide in the zero thread pitch sections 21, since the thread pitches of the thread sections are 0, the toggle members 31 only rotate planarly equivalently rather than move axially, and the telescopic rod 12 does not stretch, so that a correct discontinuous moving mode is realized. By changing the shapes of the thread grooves 2, the processing cost is low, and the comprehensive cost of the dumbbell product is effectively controlled.

As a first embodiment of the toggle bumps 31, the toggle bumps 31 are spherical bumps 311. Due to the special shapes of the thread grooves 2, the shapes of the thread grooves 2 will change abruptly at connections between the zero thread pitch sections 21 and the non-zero thread pitch sections 22, and the moving direction of the toggle members 31 will change greatly. Therefore, it is necessary to design the toggle members 31 in the smooth spherical shape to prevent the gear shifting hand feeling of the user from being affected due to interference.

Further, the toggle bumps 31 are balls, and the balls are embedded onto the toggle members 3 and are capable of rolling. By changing the fixed toggle bumps 31 into rolling balls, the gear shifting smoothness may be further improved.

As a second embodiment of the toggle bumps 31, the toggle bumps 31 are threaded bumps 312, the length of each of the threaded bumps 312 extending in an axial direction of the telescopic rod 12 is not greater than the thickness of each of the toggle members 3 in the axial direction of the telescopic rod 12, and the groove width of each of the zero thread pitch sections 21 is not less than the length of each of the threaded bumps 312 extending in the axial direction of the telescopic rod 12. The toggle bumps 31 may also be thread bumps 312, and in this case, the thread bumps 312 are shorter and match the groove sections with the non-zero thread pitches. Such thread bumps 312 slide normally in the non-zero thread pitch sections 22. When the thread bumps 312 enter into the groove sections with the zero thread pitches, since the groove sections are wider, the whole thread bumps 312 may enter into the groove sections and then the groove sections follow the thread bumps 312 to rotate. In the whole process, the thread shaft does not stretch. The thread bumps 312 have the advantage that the thread bumps are in tight fit with the groove sections with the non-zero thread pitches, so that the stretching precision of the telescopic rod 12 is high.

Figure 5:
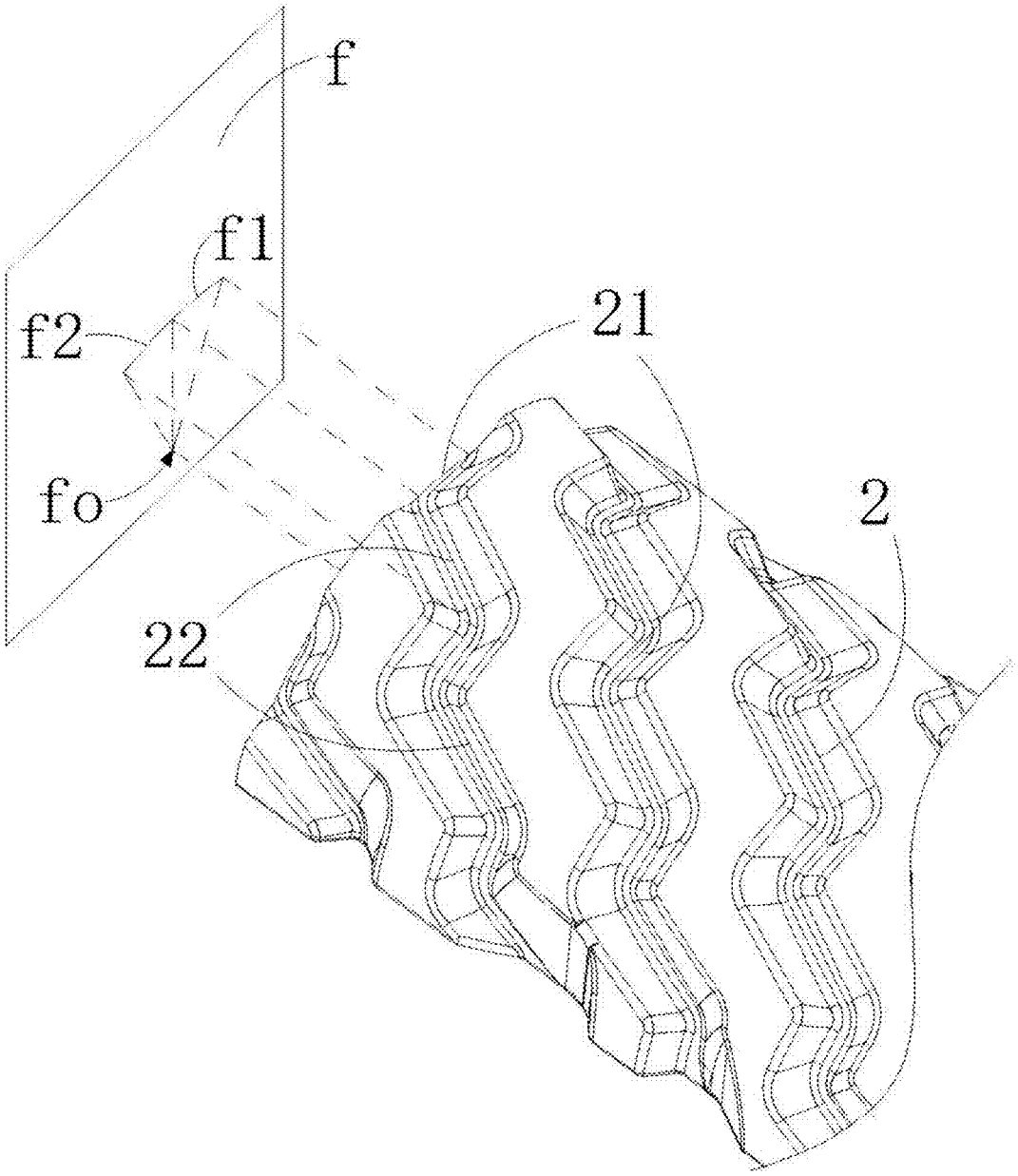
FIG. 5 is a schematic diagram of radial projections of central angles of zero thread pitch sections and non-zero thread pitch sections in the embodiment.
Figure 6:
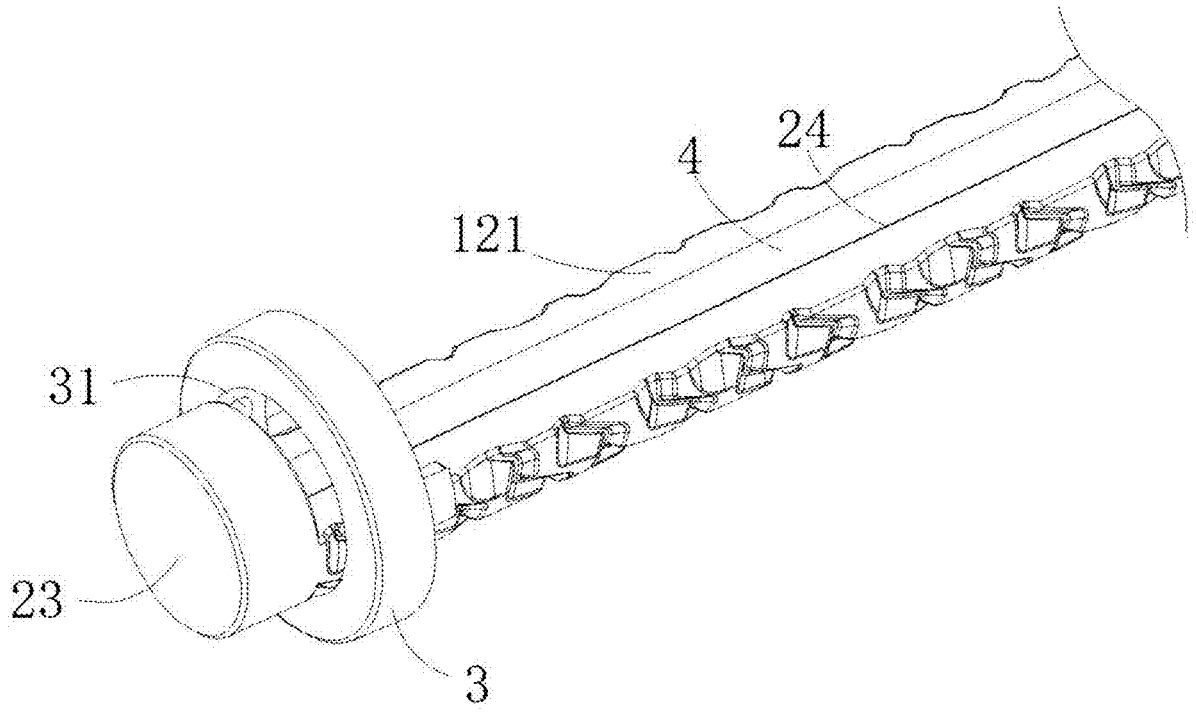
FIG. 6 is a schematic structural diagram of a guide bar in the embodiment.
Figure 7:
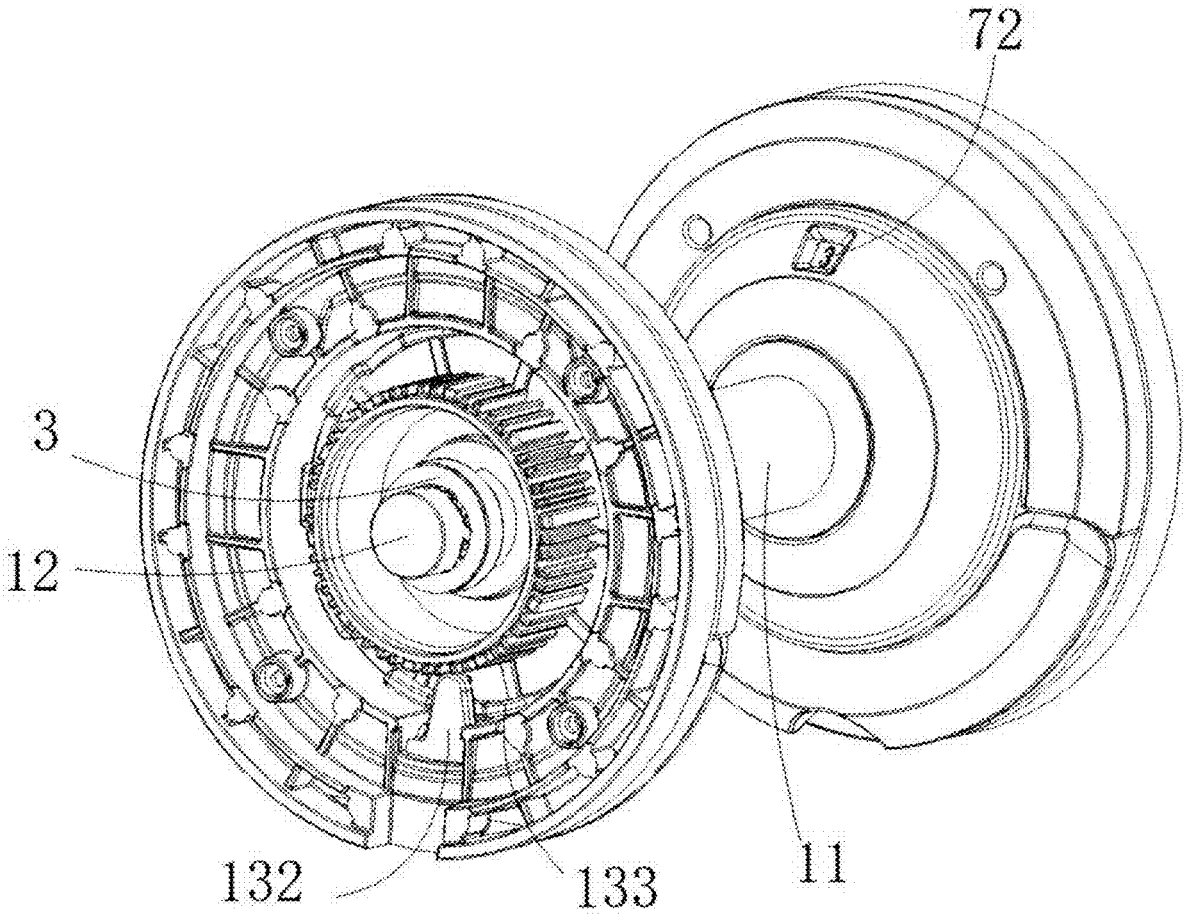
FIG. 7 is a schematic structural diagram where a weight stack matches an discontinuous connector in the embodiment.
Figure 8:
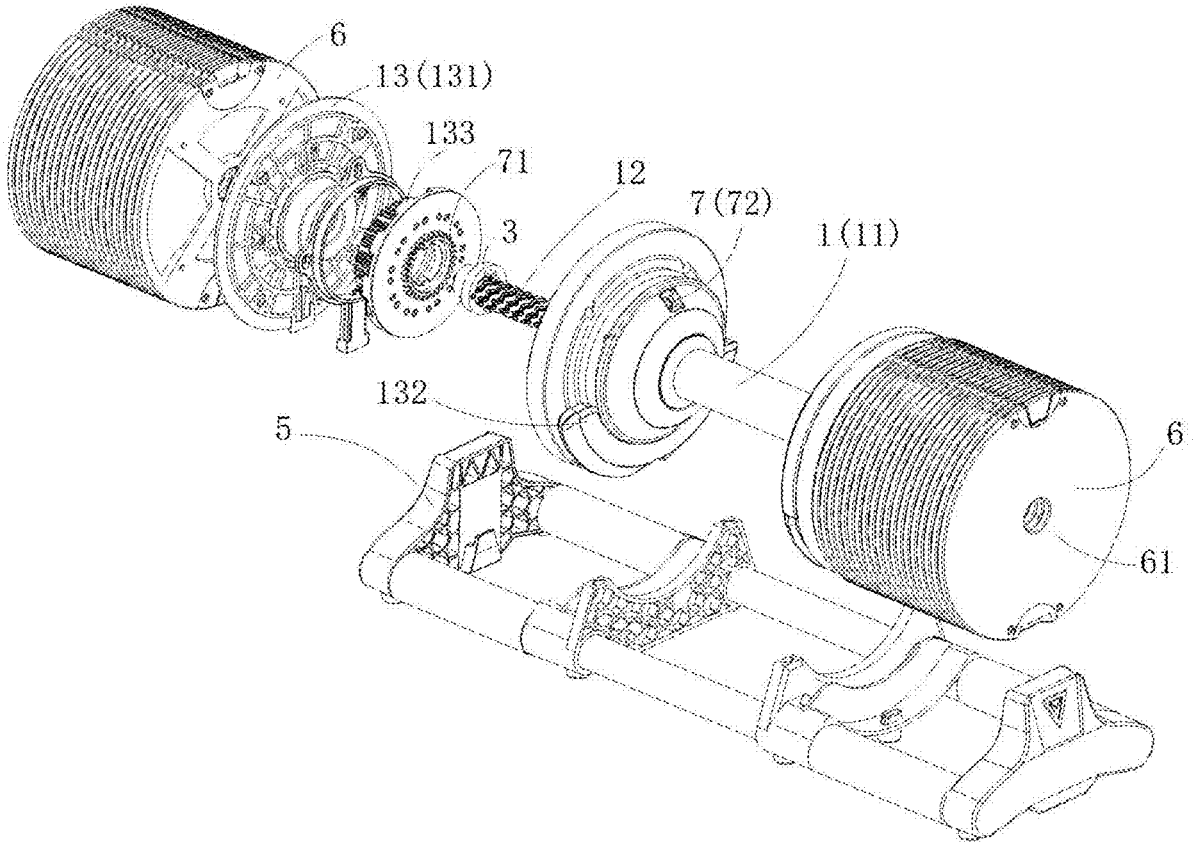
FIG. 8 is an exploded view of a dumbbell in the embodiment.

As shown in FIG. 5, the zero thread pitch sections 21 and the non-zero thread pitch sections 22 are radially projected to a radial projection plane f to obtain f1 and f2 segmental arcs equal in length and projections fo of centers of circle of the semi-cylinder rods, indicating that a projection angle of a central angle of the telescopic rod 12 corresponding to each of the zero thread pitch sections 21 is equal to a projection angle of a central angle of the telescopic rod 12 corresponding to each of the non-zero thread pitch sections 22 in a radial cross section of the telescopic rod 12. Such design may ensure that the rotating angle of each gear is consistent, which not only improves the usage experience of the user, but also is convenient to design the weight display device 7.

Further, two or more than two thread grooves 2 are respectively formed in each of the outer cylindrical surfaces of the two semi-cylindrical rods 121, and the number of the toggle bumps 31 is twice as many as the number of the thread grooves 2 of one semi-cylindrical rod 121. By arranging a plurality of toggling structures, the toggling reliability and stretching precision may be improved.

Further, the two semi-cylindrical rods 121 are respectively provided with an intact cylinder at a different ends to form an insertion head 23. Such structure may ensure that the telescopic rod 12 may match the center hole 61 intactly when stretching into the farthest weight stack, so that the weight stack falling risk is further reduced.

Further, the telescopic assembly for an adjustable dumbbell further includes guide bars 4, where guide grooves 24 are respectively formed at central axes of the two semi-cylindrical rods 121, and the guide bars 4 are mounted in the guide grooves 24. Due to special threads of the telescopic shaft, its movement is complex and changeable. By arranging the guide bars 4 and guide grooves 24, the reliability of the movement of the telescopic shaft may be ensured.

The present disclosure further provides an adjustable dumbbell, including a placing rack 5, weight stack groups 6 and a holding rod assembly 1, where two weight stack groups 6 are provided and are both provided with central holes 61, the two weight stack groups 6 are respectively arranged at both ends of the placing rack 5, and the holding rod assembly 1 is mounted between the two weight stack groups 6 and penetrating through the central holes 61; the holding rod assembly 1 includes the telescopic assembly for an adjustable dumbbell described above and a weight stack connecting assembly 13, the weight stack connecting assembly 13 includes end seat assemblies 131, weight stacks 132 and a discontinuous connector 133, two end seat assemblies 131 are provided and respectively connected to the weight stack groups 6, both ends of the rotating rod 11 are erected in the end seat assemblies 131 and are capable of rotating around a center shaft, and the discontinuous connector 133 is fixedly connected to the rotating rod 11; when the rotating shaft rotates the toggle bumps 31 to slide in the zero thread pitch sections 21 of the thread grooves 2, the discontinuous connector 133 is connected to the weight stacks 132 and the end seat assemblies 131, and the position of a telescopic shaft does not change relative to the central hole 61; and when the rotating shaft rotates and each of the toggle bumps 31 to slides in each of the non-zero thread pitch sections 22 of each of the thread grooves 2, the discontinuous connector 133 separates each of the weight stacks 132 from each of the end seat assemblies 131, and the telescopic shaft stretches out or retracts relative to the position of the central hole 61. The principle of the adjustable dumbbell product is described above, which is not repeatedly described.

Further, the adjustable dumbbell further includes a weight display device 7, where the weight display device 7 includes a driving member 71 and a display member 72, the driving member 71 is fixedly connected to a rotating shaft, and the display member 72 is in transmission connection to the driving member 71.

To sum up, according to such telescopic assembly for an adjustable dumbbell and an adjustable dumbbell, when the adjustable dumbbell adopts the semi-weight r, weight stack structure, the weight stack falling risk may be effectively reduced, the safety of the dumbbell product is improved, and the cost may be effectively controlled.

The above mentioned is merely the preferred examples of the present disclosure and is not used to limit the present disclosure. Any modification, equivalent replacement, improvement, etc. made within the spirit and principle of the present disclosure shall be regarded as within the protection scope of the present disclosure.

What is claimed is:

1. A telescopic assembly for an adjustable dumbbell, comprising a rotating rod and a telescopic rod, wherein the rotating rod is a hollow round rod; the telescopic rod comprises two semi-cylindrical rods split in half, wherein the two semi-cylindrical rods are respectively provided with an intact cylinder at a different end to form an insertion head;

the telescopic rod is inserted into the rotating rod;

two toggle members are respectively arranged at two ends of the rotating rod, respectively;

the two toggle members are fixedly connected to the rotating rod;

a plurality of toggle bumps is equally spaced and arranged on inside circle of each of the two toggle members;

thread grooves with opposite rotating directions are respectively formed in outer cylindrical surfaces of the two semi-cylindrical rods;

the toggle bumps are capable of sliding in the thread grooves of the two semi-cylindrical rods, respectively;

the thread grooves comprise zero thread pitch sections and non-zero thread pitch sections; and the zero screw pitch sections and the non-zero screw pitch sections are arranged in a staggered manner; wherein the toggle bumps are threaded bumps; the length of each of the threaded bumps extending in an axial direction of the telescopic rod is not greater than the thickness of each of the toggle members in the axial direction of the telescopic rod; the groove width of each of the zero thread pitch sections is not less than the length of each of the threaded bumps extending in the axial direction of the telescopic rod;

when the threaded bumps enter into the groove sections with the zero thread pitches, since the groove sections are wider, the threaded bumps enter into the groove sections and then the groove sections follow the threaded bumps to rotate;

the zero thread pitch sections and the non-zero thread pitch sections are radially projected to a radial projection plane to obtain a first and a second segmental arcs equal in length and projection points of centers of circle of the semi-cylinder rods; a projection angle of a central angle of the telescopic rod corresponding to each of the zero thread pitch sections is equal to a projection angle of a central angle of the telescopic rod corresponding to each of the non-zero thread pitch sections in a radial cross section of the telescopic rod;

when the threaded bumps slide in the non-zero thread pitch sections, the telescopic rod stretches and retracts normally; and when the threaded bumps slide in the zero thread pitch sections, since thread pitches of the zero thread pitch sections are 0, the threaded bumps only rotate planarly equivalently rather than move axially, and the telescopic rod does not stretch; and wherein two or more than two thread grooves are respectively formed in each of the outer cylindrical surfaces of the two semi-cylindrical rods, and the number of the threaded bumps is twice as many as the number of the thread grooves of one semi-cylindrical rod.

2. The telescopic assembly for an adjustable dumbbell according to claim 1, further comprising guide bars, wherein guide grooves are respectively formed at central axes of the two semi-cylindrical rods, and the guide bars are mounted in the guide grooves.

3. An adjustable dumbbell, comprising a placing rack, weight stack groups and a holding rod assembly, wherein two weight stack groups are provided and are both provided with central holes, the two weight stack groups are respectively arranged at both ends of the placing rack, and the holding rod assembly is mounted between the two weight stack groups and penetrating through the central holes; the holding rod assembly comprises the telescopic assembly for an adjustable dumbbell according to claim 1 and a weight stack connecting assembly, the weight stack connecting assembly comprises end seat assemblies, weight stacks and a discontinuous connector, two end seat assemblies are provided and respectively connected to the weight stack groups, both ends of the rotating rod are erected in the end seat assemblies and are capable of rotating around a center shaft, and the discontinuous connector is fixedly connected to the rotating rod;

when the rotating shaft rotates the toggle bumps to slide in the zero thread pitch sections of the thread grooves, the discontinuous connector is connected to the weight stacks and the end seat assemblies, and the position of a telescopic shaft does not change relative to the central hole; and when the rotating shaft rotates and each of the toggle bumps to slides in each of the non-zero thread pitch sections of each of the thread grooves, the discontinuous connector separates each of the weight stacks from each of the end seat assemblies, and the telescopic shaft stretches out or retracts relative to the position of the central hole.

4. The adjustable dumbbell according to claim 3, further comprising a weight display device, wherein the weight display device comprises a driving member and a display member, the driving member is fixedly connected to a rotating shaft, and the display member is in transmission connection to the driving member.

* * * * *